US008618418B2

(12) United States Patent
Amato

(10) Patent No.: US 8,618,418 B2
(45) Date of Patent: Dec. 31, 2013

(54) MULTILAYER CABLE JACKET

(75) Inventor: Alan John Amato, Cheshire, CT (US)

(73) Assignee: PPC Broadband, Inc., East Syracuse, NY (US)

( * ) Notice: Subject to any disclaimer, the term of this patent is extended or adjusted under 35 U.S.C. 154(b) by 735 days.

(21) Appl. No.: 12/432,546

(22) Filed: Apr. 29, 2009

(65) Prior Publication Data

US 2010/0276179 A1 Nov. 4, 2010

(51) Int. Cl.
*H01B 7/00* (2006.01)

(52) U.S. Cl.
USPC ..... 174/120 R; 174/106 R

(58) Field of Classification Search
USPC ..... 174/28, 106 R, 120 R
See application file for complete search history.

(56) References Cited

U.S. PATENT DOCUMENTS

| | | | | | |
|---|---|---|---|---|---|
| 3,516,859 | A | * | 6/1970 | Gerland et al. | 427/118 |
| 3,781,762 | A | * | 12/1973 | Quackenbush | 439/322 |
| 3,834,960 | A | | 9/1974 | Prentice et al. | |
| 3,867,565 | A | | 2/1975 | Prentice et al. | |
| 4,225,749 | A | | 9/1980 | Pierre et al. | |
| 4,256,921 | A | | 3/1981 | Bahder | |
| 4,399,322 | A | | 8/1983 | Hafner, Jr. | |
| 4,435,613 | A | | 3/1984 | Gaubert | |
| 4,477,693 | A | * | 10/1984 | Krabec et al. | 174/36 |
| 4,515,435 | A | * | 5/1985 | Anderson | 385/103 |
| 4,552,432 | A | | 11/1985 | Anderson et al. | |
| 4,678,709 | A | * | 7/1987 | Tondre et al. | 428/380 |
| 4,731,505 | A | | 3/1988 | Crenshaw et al. | |
| 4,980,001 | A | | 12/1990 | Cornibert et al. | |
| 5,042,904 | A | | 8/1991 | Story et al. | |
| 5,077,449 | A | | 12/1991 | Cornibert et al. | |
| 5,132,488 | A | | 7/1992 | Tessier et al. | |
| 5,293,678 | A | | 3/1994 | Chamberlain et al. | |
| 5,515,603 | A | | 5/1996 | Ziemek et al. | |
| 5,670,748 | A | * | 9/1997 | Gingue et al. | 174/120 R |
| 5,719,353 | A | | 2/1998 | Carlson et al. | |
| 5,777,260 | A | | 7/1998 | Klumps et al. | |
| 5,898,133 | A | | 4/1999 | Bleich et al. | |
| 5,922,155 | A | | 7/1999 | Clouet et al. | |
| 5,926,949 | A | | 7/1999 | Moe et al. | |
| 5,949,018 | A | | 9/1999 | Esker | |
| 6,028,975 | A | | 2/2000 | Davidson | |

(Continued)

FOREIGN PATENT DOCUMENTS

| | | | |
|---|---|---|---|
| CN | 2935394 | Y | 8/2007 |
| DE | 904301 | C | 3/1954 |

(Continued)

OTHER PUBLICATIONS

PCT/US2010/032289, International Filing Date: Apr. 23, 2010. International Search Report and Written Opinion. Date of Mailing: Nov. 19, 2010. 8 pages.

(Continued)

*Primary Examiner* — Chau Nguyen
(74) *Attorney, Agent, or Firm* — Hiscock & Barclay LLP

(57) ABSTRACT

A multilayer cable jacket. In one example embodiment, a cable includes one or more internal components and a multilayer jacket surrounding the one or more internal components. The one or more internal components include at least one electrical conductor configured to propagate a signal. The multilayer jacket includes an inner layer surrounded by an outer layer with the inner layer being less rigid than the outer layer.

25 Claims, 3 Drawing Sheets

(56) References Cited

U.S. PATENT DOCUMENTS

| | | | | |
|---|---|---|---|---|
| 6,265,667 | B1 | 7/2001 | Stipes et al. | |
| 6,317,541 | B1 | 11/2001 | Davidson | |
| 6,392,152 | B1 * | 5/2002 | Mottine et al. | 174/110 PM |
| 6,534,715 | B1 | 3/2003 | Maunder et al. | |
| 6,547,908 | B2 | 4/2003 | Keyes et al. | |
| 6,683,256 | B2 * | 1/2004 | Kao | 174/110 R |
| 6,756,538 | B1 * | 6/2004 | Murga-Gonzalez et al. | 174/28 |
| 7,157,645 | B2 * | 1/2007 | Huffman | 174/120 R |
| 7,271,344 | B1 | 9/2007 | Stutzman et al. | |
| 2004/0184748 | A1 | 9/2004 | Clatanoff et al. | |
| 2004/0216913 | A1 | 11/2004 | Wiekhorst et al. | |
| 2007/0209824 | A1 | 9/2007 | Stutzman et al. | |
| 2008/0115959 | A1 | 5/2008 | Stutzman et al. | |
| 2009/0151970 | A1 * | 6/2009 | Abe et al. | 174/28 |
| 2011/0132633 | A1 | 6/2011 | Montena | |

FOREIGN PATENT DOCUMENTS

| | | | |
|---|---|---|---|
| JP | 2001159725 | A | 6/2001 |
| JP | 2006147410 | A | 6/2006 |
| WO | WO-2007/148685 | * | 12/2007 |

OTHER PUBLICATIONS

U.S. Appl. No. 12/631,639, filed Dec. 4, 2009.

* cited by examiner

MULTILAYER CABLE JACKET

BACKGROUND

Telecommunication cables often include an outer protective jacket that serves to protect the internal components of the cable from external contaminants and/or forces. For example, a typical coaxial cable includes a center conductor surrounded by a dielectric, an outer conductor, and an outer protective jacket. Some protective jackets are made from a relatively rigid material in order to protect the internal components of the cable. A cable with a rigid protective jacket can be especially useful when the cable is installed outdoors, whether aerially or underground, due to the extra protection provided such a jacket.

Unfortunately, the rigidity of the outer jacket can give rise to several problems. For example, a coaxial cable with a rigid protective jacket can be very difficult to terminate with a typical cable connector. A typical cable connector utilizes a post (or similar structure) that must slide underneath and thereby expand the protective jacket to be properly installed. A rigid jacket can require a high insertion force to fully and properly insert the post underneath the jacket. Further, because plastics become more rigid as they are exposed to lower temperatures, the required amount of insertion force increases with any drop in the ambient temperature of the cable. Consequently, cold weather installation of a typical cable connector can be very difficult or even impossible on a cable that includes a rigid protective jacket.

SUMMARY OF SOME EXAMPLE EMBODIMENTS

In general, example embodiments of the present invention relate to a multilayer cable jacket that serves to protect internal components of the cable. Moreover, disclosed embodiments provide a multilayer cable jacket that reduces the amount of insertion force required to fully insert the post of a typical cable connector underneath the jacket, even when the cable is exposed to low temperature conditions.

In one example embodiment, a cable includes one or more internal components and a multilayer jacket surrounding the one or more internal components. The one or more internal components include at least one electrical conductor configured to propagate a signal. While other multilayer configurations could be used, in disclosed embodiments the multilayer jacket includes an inner layer surrounded by an outer layer. The inner layer is configured with a material, or combination of materials, that is relatively less rigid than the rigidity of the outer layer material(s). Use of a multilayer jacket is advantageous in a number of respects. In particular, the ability to provide a protective jacket with a less rigid inner layer provides a jacket that is able to easily accommodate the post of a cable connector, thereby reducing the amount of insertion force needed to install the connector—even in low temperature conditions. At the same time, the outer layer—which is more rigid—provides sufficient protection to the inner components of the cable.

In another example embodiment, a method for manufacturing a cable having one or more internal components is disclosed. First, the one or more internal components are surrounded with an inner jacket layer. The one or more internal components include at least one electrical conductor configured to propagate a signal. The inner jacket layer is next surrounded with an outer jacket layer. The inner jacket layer is made from one or more materials that are relatively less rigid than the material(s) used to configure the outer jacket layer.

In yet another example embodiment, a method for manufacturing a coaxial cable is disclosed. In a disclosed embodiment, a center conductor is surrounded with a dielectric. The center conductor is configured to propagate a signal. Next, the dielectric is surrounded with an outer conductor. Then, an inner jacket layer is extruded over the outer conductor. Finally, an outer jacket layer is extruded over the inner jacket layer. Again, the inner jacket layer is comprised of a material or materials that are relatively less rigid than the material(s) used to form the outer jacket layer.

Each of these disclosed embodiments provide a number of potential advantages. For example, each disclosed embodiment provides a protective outer jacket that serves to protect the internal components of a cable from external contaminants and forces. In addition, disclosed embodiments address critical problems in the prior art, including the ability to provide for easier installation of a cable connector (or similar component) because of the reduced force needed to fully insert the post—even in cold temperature conditions.

This Summary is provided to introduce a selection of concepts in a simplified form that are further described below in the Detailed Description. This Summary is not intended to identify key features or essential characteristics of the claimed subject matter, nor is it intended to be used as an aid in determining the scope of the claimed subject matter. Moreover, it is to be understood that both the foregoing general description and the following detailed description of the present invention are exemplary and explanatory and are intended to provide further explanation of the invention as claimed.

BRIEF DESCRIPTION OF THE DRAWINGS

Aspects of example embodiments of the present invention will become apparent from the following detailed description of example embodiments given in conjunction with the accompanying drawings, in which.

DETAILED DESCRIPTION OF SOME EXAMPLE EMBODIMENTS

Example embodiments of the present invention relate to a multilayer cable jacket. In the following detailed description of some example embodiments, reference will now be made in detail to specific embodiments of the present invention, examples of which are illustrated in the accompanying drawings. Wherever possible, the same reference numbers will be used throughout the drawings to refer to the same or like parts. These embodiments are described in sufficient detail to enable those skilled in the art to practice the invention. Other embodiments may be utilized and structural, logical and electrical changes may be made without departing from the scope of the present invention. Moreover, it is to be understood that the various embodiments of the invention, although different, are not necessarily mutually exclusive. For example, a particular feature, structure, or characteristic described in one embodiment may be included within other embodiments. The following detailed description is, therefore, not to be taken in a limiting sense, and the scope of the present invention is defined only by the appended claims, along with the full scope of equivalents to which such claims are entitled.

I. Example Coaxial Cable

Figure 1A:
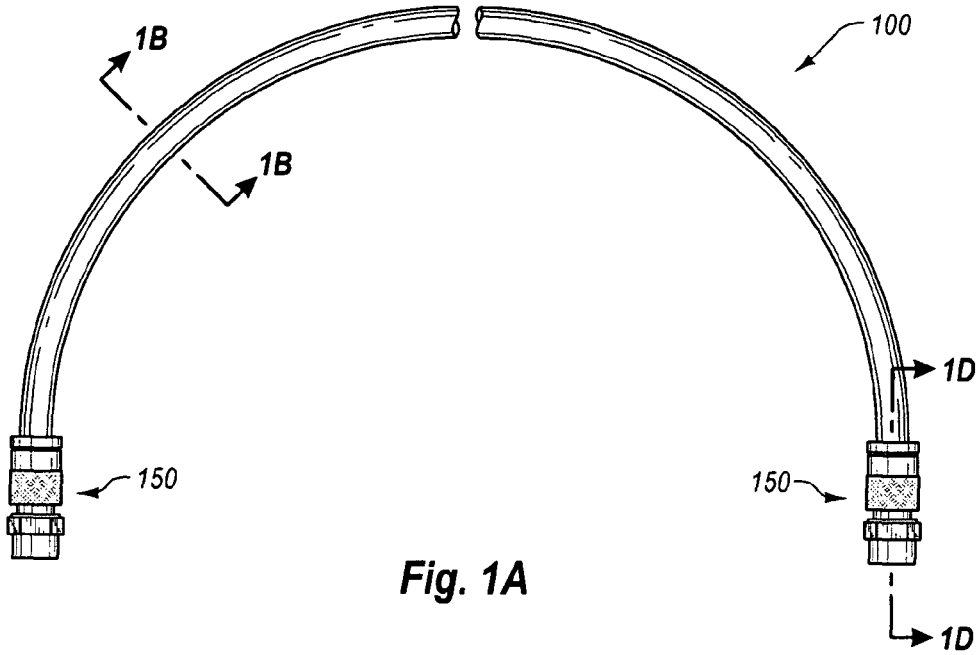
FIG. 1A is a perspective view of an example coaxial cable that terminates with two example connectors.

With reference first to FIG. 1A, an example coaxial cable 100 is disclosed. The example coaxial cable 100 can be any type of coaxial cable including, but not limited to, 50 Ohm and 75 Ohm coaxial cables. As disclosed in FIG. 1A, the example coaxial cable 100 is terminated on either end with connectors 150. Although connectors 150 are disclosed in FIG. 1A as F-type female connectors, it is understood that cable 100 can also be terminated with other types of female and/or male connectors (not shown). Further, although example embodiments are disclosed in the context of a coaxial cable and connectors, it will be appreciated that other types of cables and/or cable components might also be used.

Figure 1B:
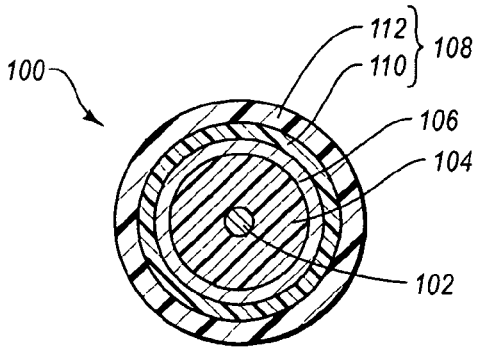
FIG. 1B is a cross-sectional view of the example coaxial cable of FIG. 1A.
Figure 1C:
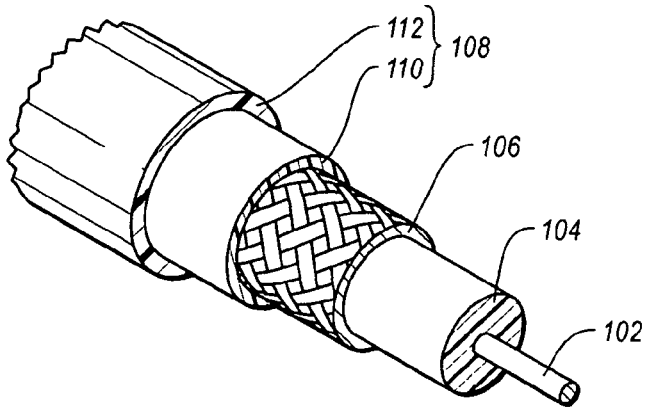
FIG. 1C is perspective view of a portion of the coaxial cable of FIG. 1A with portions of each layer cut away.

With reference now to FIGS. 1B and 1C, the coaxial cable generally includes a center conductor 102 surrounded by a dielectric 104, an outer conductor 106 surrounding the dielectric, and a multilayer jacket 108 surrounding the outer conductor 106. As disclosed in FIGS. 1B and 1C, the multilayer jacket 108 generally includes an inner layer 110 surrounded by an outer layer 112. As used herein, the phrase "surrounded by" refers to an inner layer generally being encased by an outer layer. However, it is understood that an inner layer may be "surrounded" by an outer layer without the inner layer being immediately adjacent to the outer layer. The term "surrounded" thus allows for the possibility of intervening layers. Each of these components of the example coaxial cable 100 will now be discussed in turn.

The center conductor 102 is positioned at the core of the example coaxial cable 100. The center conductor 102 is configured to carry a range of electrical current (amperes) as well as propagate an RF/electronic digital signal. In some example embodiments, the center conductor 102 is formed from solid copper, copper-clad aluminum (CCA), copper-clad steel (CCS), or silver-coated copper-clad steel (SCCCS), although other conductive materials are possible. For example, the center conductor 102 can be formed from any type of conductive metal or alloy. In addition, the center conductor 102 can be solid, hollow, stranded, corrugated, plated, or clad, for example.

The dielectric 104 surrounds the center conductor 102, and generally serves to support and insulate the center conductor 102 and the outer conductor 106. Although not shown in the figures, a bonding agent, such as a polymer, can be employed to bond the dielectric 104 to the center conductor 102. In some example embodiments, the dielectric 104 can be, but is not limited to, taped, solid, or foamed polymer or fluoropolymer. For example, the dielectric 104 can be foamed polyethylene (PE).

The outer conductor 106 surrounds the dielectric 104, and generally serves to minimize the ingress and egress of radio frequency (RF) signals to/from the center conductor 102. Although the outer conductor 106 is disclosed in FIGS. 1B and 1C as constituting a tape layer and a braid layer, it is understood that the outer conductor 106 can in fact be formed from only one layer or more than two layers.

For example, the outer conductor 106 can include one or more layers of tape to shield against high frequency RF signals and can also include one or more layers of braid to shield against low frequency RF signals. The tape laminate can include, but is not limited to, the following layers: aluminum/polymer/adhesive, aluminum/polymer/aluminum/adhesive, aluminum/polymer, or aluminum/polymer/aluminum, for example. It is understood, however, that the discussion herein of tape is not limited to tape having any particular combinations of layers. The braid can be formed from inter-woven, fine gauge aluminum or copper wires, such as 34 American wire gauge (AWG) wires, for example. It is understood, however, that the discussion herein of braid is not limited to braid formed from any particular type or size of wire. Each layer of tape and/or braid increases the effectiveness of the shielding of high and low frequency RF signals by the outer conductor 106.

The multilayer jacket 108 surrounds the dielectric 104, and generally serves to protect the internal components of the coaxial cable 100 from external contaminants, such as dust, moisture, and oils, for example. In a typical embodiment, the jacket 108 also functions to limit the bending radius of the cable to prevent kinking, and functions to protect the cable (and its internal components) from being crushed or otherwise misshapen from an external force. As noted elsewhere herein, the example multilayer jacket 108 generally includes the inner layer 110 surrounded by the outer layer 112. Moreover, the inner layer 110 is formed from a material that is relatively less rigid than the material from which the outer layer 112 is formed.

For example, the outer layer 112 can be formed from a relatively rigid material such as, but not limited to, polyethylene (PE), high-density polyethylene (HDPE), low-density polyethylene (LDPE), or linear low-density polyethylene (LLDPE), or some combination thereof. The actual material used might be indicated by the particular application/environment contemplated. For example, the relatively high rigidity and stiffness provided by PE indicates that this material might be employed in coaxial cable intended for underground or aerial outdoor installation due to its tensile strength, impact resistance, crush resistance, compression resistance, abrasion resistance, and relatively low cost. These characteristics of PE make it superior in performance as a jacket material as compared to softer materials, such as rubberized polyvinyl chloride (PVC). However, as previously noted, jackets made entirely from a rigid, substantially non-compressible material such as PE tend to require an excessive amount of insertion force to fully insert the post of a cable connector (or similar component) underneath the jacket.

For this reason, the inner layer 112 is formed from a relatively less rigid and more pliable material such as, but not limited to, foamed PE, polyvinyl chloride (PVC), or polyurethane (PU), or some combination thereof The relative pliability of the inner layer 110 as compared to the outer layer 112 reduces the amount of insertion force required to fully insert the post of a cable connector underneath the multilayer jacket 108.

Figure 1D:
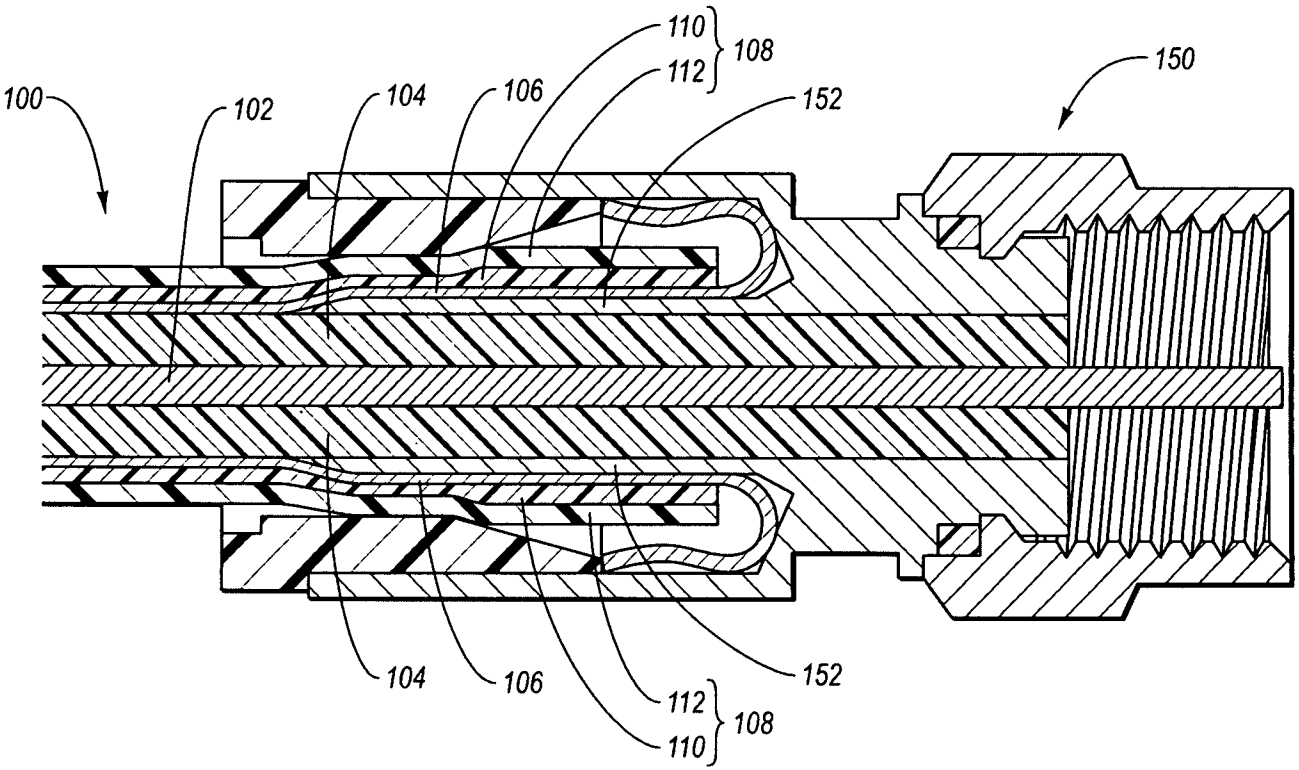
FIG. 1D is another cross-sectional view of the example coaxial cable and one of the example connectors of FIG. 1A.

With reference now to FIG. 1D, an end of the coaxial cable 100 terminated with the cable connector 150 is disclosed. As disclosed in FIG. 1D, during installation a post 152 of the cable connector 150 is slid underneath the multilayer jacket 108. It is understood, as disclosed in FIG. 1D, that the post 152 may further be slid underneath the outer conductor 106. Alternatively, the post 152 may instead be slid over one or more of the layers of a multilayer outer conductor, such as a tape layer, and be slid underneath one or more of the layers of the multilayer outer conductor, such as a braid layer.

The relatively pliable inner layer 110 enables the inner layer 110 to compress and thereby accommodate the shape of the post 152. In this way, the post 152 can be fully inserted under the multilayer jacket 108 with less insertion force than would be required to fully insert the post 152 under a single-layer jacket made entirely of the same substantially non-compressible material as the rigid outer layer 112.

Further, the relatively pliable inner layer 110 is particularly advantageous in low ambient temperatures. For example, although cold weather installation of the cable connector 150 onto a rigid single-layer jacketed cable can be difficult or impossible, the cable connector 150 can be installed with relative ease onto the example coaxial cable 100 in cold weather due to the required insertion force being considerably reduced by virtue of the compliant, compressible inner layer 110. Therefore, the cable connector 150 can be installed on the example coaxial cable 100 in cold weather where installation was previously difficult or impossible with a coaxial cable having only a rigid single-layer jacket. At the same time, the relatively rigid outer layer 112 provides the protection necessary for the internal components of the coaxial cable 100.

One advantage of the design of the multilayer jacketed cable 100 can be seen below by comparing estimations of required connector insertion forces of a rigid single-layer jacketed cable and of the example multilayer jacketed cable 100. The connector insertion force of a cable can be estimated by considering the jacket tensile strength and the area of materials that will attempt to displace the jacket material. For example, the area $A_B$ of the braid wires in a rigid single-layer jacketed cable, or in the outer conductor 106 of the example cable 100, can be calculated as follows:

$$\begin{aligned} A_B &= B_{NE} \times \frac{\pi}{4} \times (D_B^2) \\ &= 68 \times \frac{\pi}{4} \times (0.0063^2) \\ &= 0.0021 \text{ square inches} \end{aligned} \tag{1}$$

Similarly, the area $A_{CP}$ of the connector post 152 of the cable connector 150 can be calculated as follows:

$$\begin{aligned} A_{CP} &= \frac{\pi}{4} \times (D_{CP}^2) \\ &= \frac{\pi}{4} \times (0.225^2) \\ &= 0.0400 \text{ square inches} \end{aligned} \tag{2}$$

These two areas $A_B$ and $A_{CP}$ can then be used to estimate the insertion force $F_{IEA}$ required to attach the connector post 152 onto a rigid single-layer LDPE jacketed cable as follows:

$$F_{IEA}=T_J\times(A_B+A_{CP})=2000\times(0.0021+0.0400)=84.2 \text{ pounds} \tag{3}$$

Similarly, the insertion force $F_{IPA}$ required to attach the connector post 152 onto the example multilayer jacketed cable 100 with a relatively pliable inner layer 110 formed from foamed LDPE can be estimated as follows:

$$F_{IPA}=T_{FJ}\times(A_B+A_{CP})=757\times(0.0021+0.0400)=31.9 \text{ pounds} \tag{4}$$

These calculations and estimations are based on the following assumptions:

$T_J$=LDPE jacket tensile strength=2,000 pounds per square inch $T_{FJ}$=tensile strength of foamed LDPE=757 pounds per square inch $D_B$=braid wire diameter=0.0063 inches $B_{NE}$=number of braid ends per cable=68

$D_{CP}$=diameter of connector post=0.225 inches

Therefore, in at least one example embodiment, the insertion force $F_{IPA}$ required to attach the connector post 152 onto the example cable 100 (31.9 pounds) is 52.3 pounds less than the insertion force $F_{IEA}$ required to attach the same connector post 152 onto a rigid single-layer jacketed cable (84.2 pounds). This decrease in the required insertion force is due to the multilayer design of the relatively pliable inner layer 110 and the relatively rigid outer layer 112 of the example cable 100.

Although the multilayer jacket 108 is disclosed herein as generally including a single inner layer 110 surrounded by a single outer layer 112, it is understood that the multilayer jacket 108 can in fact be formed from more than two layers, as long as the multilayer jacket 108 includes at least one relatively pliable inner layer and one relatively rigid outer layer.

II. Example Method for Manufacturing a Coaxial Cable

Figure 2:
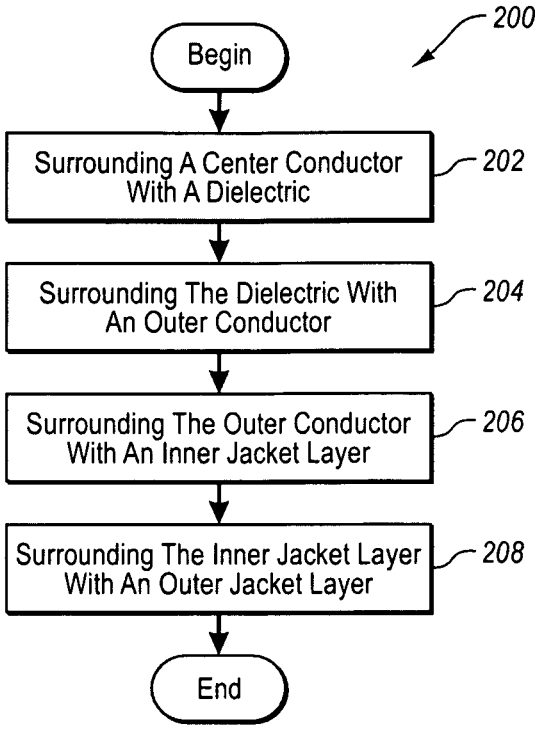
FIG. 2 is a flowchart of an example method for manufacturing the example coaxial cable of FIG. 1A.

With continued reference to FIGS. 1B and 1C, and with reference also to FIG. 2, an example method 200 for manufacturing the example coaxial cable 100 is disclosed.

At step 202, the center conductor 102 is surrounded with the die 104. For example, the center conductor 102 can be fed through a first extruder where a pre-coat of a bonding agent, such as a polymer, is applied. The pre-coated center conductor 102 can then be fed through a second extruder where the dielectric 104 is applied so as to surround the center conductor 102. Alternatively, the step 202 may be omitted altogether where the center conductor 102 has been surrounded with the dielectric 104 prior to the performance of the example method 200.

Next, at step 204, the dielectric 104 is surrounded with the outer conductor 106. As noted above, the outer conductor 106 can be formed from alternating layers of tape and/or braid. For example, the dielectric 104 and the component(s) it surrounds can be fed through one or more wrapping operations that each wraps a layer of tape around the dielectric 104. Similarly, each layer of tape can be fed through one or more braiding operations that each braid, weave, or wrap a layer of braid around each layer of tape, for example. Alternatively, the step 204 may be omitted altogether where the dielectric 104 has been surrounded with the outer conductor 106 prior to the performance of the example method 200.

Then, at step 206, the outer conductor 106 is surrounded with the inner layer 110 of the multilayer jacket 108. For example, the outer conductor 106 and the components it surrounds can be fed through a third extruder where the inner layer 110 of the multilayer jacket 108 is applied so as to surround the outer conductor 106.

Finally, at step 208, the inner layer 110 of the multilayer jacket 108 is surrounded with the outer layer 112 of the multilayer jacket 108. For example, the inner layer 110 and the components it surrounds can be fed through a fourth extruder where the outer layer 112 of the multilayer jacket 108 is applied so as to surround inner layer 110.

Thus, the example method 200 can be employed to form the example coaxial cable 100. As disclosed elsewhere herein, the orientation of the relatively pliable inner layer 110 with respect to the relatively rigid outer layer 112 makes the termination of the coaxial cable 100 with the cable connector 150 less difficult, especially during cold weather installation of the cable connector 150.

III. Alternative Embodiments

Although the example embodiments are described in the context of a standard coaxial cable, it is understood that other cable configurations may likewise benefit from the multilayer jacket 108 disclosed herein. For example, flooded coaxial cables and/or messengered coaxial cables can be configured to include a multilayer jacket. In addition, although the example cable connectors 150 disclosed herein are configured as standard female F-type connectors, other connectors or cable components that include a post (or similar structure) that must slide underneath or otherwise mate with the cable jacket can similarly benefit from the multilayer jacket 108 disclosed herein.

Further, although the discussion herein deals generally with coaxial cables, it is understood that other types of cables, such as other telecommunication cable types, can be configured to include a multilayer jacket incorporating the inventive concepts disclosed herein. Although the internal components of the example coaxial cable 100 include a center conductor 102, a dielectric 104, and an outer conductor 106, it is understood that cables with other types of internal components can similarly benefit from a multilayer jacket of the sort claimed herein. In general, any cable, with any combination of internal components, that can be terminated with a connector (or similar component) that includes a post that must slide underneath or otherwise mate with the cable jacket can similarly benefit from the inventive concepts disclosed herein.

The example embodiments disclosed herein may be embodied in other specific forms. The example embodiments disclosed herein are to be considered in all respects only as illustrative and not restrictive.

What is claimed is:

1. A cable comprising:

one or more internal components comprising at least one electrical conductor to propagate a signal;

a dielectric surrounding the electrical conductor;

a multilayer outer conductor surrounding the dielectric, wherein the multilayer outer conductor is configured for RF shielding, and wherein the multilayer outer conductor is aligned coaxially with the at least one electrical conductor;

a multilayer jacket surrounding the multilayer outer conductor, the multilayer jacket comprising a compressible inner jacket layer surrounded by a non-compressible rigid outer jacket layer, wherein the inner jacket layer is less rigid than the outer jacket layer, wherein a relative pliability of the inner jacket layer with respect to the outer jacket layer reduces an amount of insertion force required to fully insert a post of a cable connector underneath the multilayer jacket, wherein a portion of the inner jacket layer comprises at least one compressed portion when the post of the cable connector is fully inserted underneath the multilayer jacket, wherein the at least one compressed portion comprises a first thickness differing from a second thickness of a non-compressed portion of the inner jacket layer, and wherein the first thickness is less than the second thickness.

2. The cable as recited in claim 1, wherein the at least one electrical conductor comprises a center conductor.

3. The cable as recited in claim 1, wherein the outer jacket layer comprises polyethylene (PE).

4. The cable as recited in claim 1, wherein the outer jacket layer comprises high-density polyethylene (HOPE), low-density polyethylene (LOPE), or linear low-density polyethylene (LLDPE), or some combination thereof.

5. The cable as recited in claim 1, wherein the inner jacket layer comprises foamed PE.

6. The cable as recited in claim 1, wherein the inner jacket layer comprises polyvinyl chloride (PVC).

7. The cable as recited in claim 1, wherein the inner jacket layer comprises polyurethane (PU).

8. A coaxial cable comprising:

a center conductor;

a dielectric surrounding the center conductor;

a conductive tape layer surrounding the dielectric;

a conductive braid layer surrounding the conductive tape layer, wherein the conductive tape layer in combination with the conductive braid layer is configured for RF shielding, and wherein the conductive tape layer and the conductive braid layer are each aligned coaxially with the center conductor; and a multilayer jacket surrounding the conductive braid layer, the multilayer jacket comprising a compressible inner jacket layer surrounded by a non-compressible rigid outer jacket layer, wherein the inner jacket layer is less rigid than the outer jacket layer, wherein a relative pliability of the inner jacket layer with respect to the outer jacket layer reduces an amount of insertion force required to fully insert a post of a cable connector underneath the multilayer jacket, wherein a portion of the inner jacket layer comprises at least one compressed portion when the post of the cable connector is fully inserted underneath the multilayer jacket, wherein the at least one compressed portion comprises a first thickness differing from a second thickness of a non-compressed portion of the inner jacket layer, and wherein the first thickness is less than the second thickness.

9. The coaxial cable as recited in claim 8, further comprising a second conductive tape surrounding the conductive braid and surrounded by the multilayer jacket.

10. The coaxial cable as recited in claim 8, wherein the coaxial cable is a flooded coaxial cable and/or a messengered coaxial cable.

11. The coaxial cable as recited in claim 8, wherein the outer jacket layer comprises PE, HDPE, LDPE, or LLDPE, or some combination thereof.

12. The coaxial cable as recited in claim 8, wherein the inner jacket layer comprises foamed PE.

13. The coaxial cable as recited in claim 8, wherein the inner jacket layer comprises PVC.

14. The coaxial cable as recited in claim 8, wherein the inner jacket layer comprises PU.

15. A coaxial cable comprising:

a center conductor;

a dielectric surrounding the center conductor;

a first conductive tape layer surrounding the dielectric;

a first conductive braid layer surrounding the first conductive tape layer;

a second conductive tape layer surrounding the first conductive braid layer;

a second conductive braid layer surrounding the second conductive tape layer, wherein the first conductive tape layer in combination with the second conductive tape layer, the first conductive braid layer, and the second conductive braid layer is configured for RF shielding, and wherein the first conductive tape layer, the second conductive tape layer, the first conductive braid layer, and the second conductive braid layer are each aligned coaxially with the center conductor; and a non-compressible rigid outer jacket layer, a multilayer jacket surrounding the second conductive braid layer, the multilayer jacket comprising a compressible inner jacket layer surrounded by a non-compressible rigid outer jacket layer, wherein the inner jacket layer is less rigid than the outer jacket layer, wherein a relative pliability of the inner jacket layer with respect to the outer jacket layer reduces an amount of insertion force required to fully insert a post of a cable connector underneath the multilayer jacket, wherein a portion of the inner jacket layer comprises at least one compressed portion when the post of the cable connector is fully inserted underneath the multilayer jacket, wherein the at least one compressed portion comprises a first thickness differing from a second thickness of a non-compressed portion of the inner jacket layer, and wherein the first thickness is less than the second thickness.

16. The coaxial cable as recited in claim 15, wherein the coaxial cable is a flooded coaxial cable and/or a messengered coaxial cable.

17. The coaxial cable as recited in claim 15, wherein the outer jacket layer comprises PE, HDPE, LDPE, or LLDPE, or some combination thereof.

18. The coaxial cable as recited in claim 15, wherein the inner jacket layer comprises foamed PE.

19. The coaxial cable as recited in claim 15, wherein the inner jacket layer comprises PVC.

20. The coaxial cable as recited in claim 15, wherein the inner jacket layer comprises PU.

21. The cable as recited in claim 1, wherein the multilayer jacket further comprises a plurality of intervening layers formed between the compressible inner jacket layer and the outer jacket layer.

22. The cable as recited in claim 1, wherein the compressible inner jacket layer comprises a combination of foamed PE, PVC, and PU.

23. The cable as recited in claim 1, further comprising the cable connector comprising the post fully inserted underneath the multilayer jacket.

24. The cable as recited in claim 1, wherein the multilayer jacket comprises a plurality of intermediate layers formed between the compressible inner jacket layer and the outer jacket layer.

25. The cable as recited in claim 1, wherein the at least one compressed portion is formed between the non-compressed portion of the inner jacket layer and an additional non-compressed portion of the inner jacket layer.

* * * * *